US007048078B2

(12) United States Patent
Dewey et al.

(10) Patent No.: US 7,048,078 B2
(45) Date of Patent: May 23, 2006

(54) EXPANDABLE UNDERREAMER/STABILIZER

(75) Inventors: Charles H. Dewey, Houston, TX (US); Wei Xu, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/841,314

(22) Filed: May 7, 2004

(65) Prior Publication Data

US 2004/0206549 A1 Oct. 21, 2004

Related U.S. Application Data

(62) Division of application No. 10/078,067, filed on Feb. 19, 2002, now Pat. No. 6,732,817.

(51) Int. Cl.
*E21B 10/32* (2006.01)

(52) U.S. Cl. ..... 175/57; 175/269; 175/291; 175/344; 175/391; 175/406

(58) Field of Classification Search ..... 175/57, 175/263, 266, 267, 269, 291, 344, 385, 391, 175/406, 76
See application file for complete search history.

(56) References Cited

U.S. PATENT DOCUMENTS

| | | | | |
|---|---|---|---|---|
| 3,224,507 A | | 12/1965 | Cordary et al. | 166/55.8 |
| 3,425,500 A | | 2/1969 | Fuchs | 175/269 |
| 4,055,226 A | | 10/1977 | Weber | 175/273 |
| 4,660,657 A | | 4/1987 | Furse et al. | 175/269 |
| 4,848,490 A | | 7/1989 | Anderson | 175/323 |
| 5,014,780 A | | 5/1991 | Skipper | |
| 5,060,736 A | | 10/1991 | Neff | |
| 5,318,137 A | | 6/1994 | Johnson et al. | 175/40 |
| 5,318,138 A | | 6/1994 | Dewey et al. | 175/74 |
| 5,332,048 A | | 7/1994 | Underwood et al. | 175/26 |
| 5,368,114 A | * | 11/1994 | Tandberg et al. | 175/267 |
| 5,765,653 A | | 6/1998 | Doster et al. | 175/75 |
| 5,971,085 A | * | 10/1999 | Colebrook | 175/266 |
| 6,039,131 A | | 3/2000 | Beaton | 175/376 |
| 6,059,051 A | * | 5/2000 | Jewkes et al. | 175/76 |
| 6,213,226 B1 | | 4/2001 | Eppink et al. | 175/61 |
| 6,227,312 B1 | | 5/2001 | Eppink et al. | 175/57 |
| 6,269,893 B1 | | 8/2001 | Beaton et al. | 175/391 |
| 6,289,999 B1 | | 9/2001 | Dewey et al. | 175/38 |

(Continued)

FOREIGN PATENT DOCUMENTS

EP 0301890 A2 2/1989

(Continued)

OTHER PUBLICATIONS

British Search Report dated Jun. 9, 2003, Application No. GB 0302983.2, 3 pgs.

(Continued)

*Primary Examiner*—Zakiya W. Bates
(74) *Attorney, Agent, or Firm*—Conley Rose, P.C.; Shannon W. Bates

(57) ABSTRACT

A downhole tool that functions as an underreamer or as a stabilizer in an underreamed borehole. The tool includes one or more moveable arms disposed within a body having a flowbore therethrough in fluid communication with the wellbore annulus. The tool alternates between collapsed and expanded positions in response to differential fluid pressure between the flowbore and the wellbore annulus. In one embodiment, the tool moves automatically in response to differential pressure. In a second embodiment, the tool must be selectively actuated before it is moveable. The tool may include borehole engaging pads that comprise cutting structures or wear structures or both, depending upon the function of the tool.

16 Claims, 8 Drawing Sheets

U.S. PATENT DOCUMENTS

| | | | | |
|---|---|---|---|---|
| 6,360,831 | B1 | 3/2002 | Akesson et al. | |
| 6,378,632 | B1 | 4/2002 | Dewey et al. | 175/269 |
| 6,494,272 | B1 | 12/2002 | Eppink et al. | 175/57 |
| 6,732,817 | B1 * | 5/2004 | Dewey et al. | 175/57 |

FOREIGN PATENT DOCUMENTS

| | | | |
|---|---|---|---|
| EP | 0594420 | A1 | 4/1994 |
| WO | WO 00/31371 | A | 6/2000 |

OTHER PUBLICATIONS

French Preliminary Search Report dated Feb. 4, 2005, for Appln. No. FR0301965, 4 pgs.
British Examination Report dated Feb. 15, 2005, for Appln. No. GB0302983.2, 2 pgs.

* cited by examiner

EXPANDABLE UNDERREAMER/STABILIZER

CROSS-REFERENCE TO RELATED APPLICATIONS

The present application is a divisional continuing application of U.S. patent application Ser. No. 10/078,067 filed Feb. 19, 2002 now U.S. Pat. No. 6,732,817.

STATEMENT REGARDING FEDERALLY SPONSORED RESEARCH OR DEVELOPMENT

Not Applicable.

BACKGROUND OF THE INVENTION

1. Field of the Invention

The present invention relates generally to underreamers used for enlarging a borehole below a restriction to result in a borehole that is larger than the restriction. The present invention also relates generally to stabilizers used for controlling the trajectory of a drill bit during the drilling process. More particularly, the present invention relates to an expandable tool that may function as an underreamer, or alternatively, may function as a stabilizer in an underreamed portion of borehole. Still more particularly, the present invention relates to an expandable tool having arms that expand when a piston is exposed to fluid circulating through the borehole.

2. Description of the Related Art

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is typically used in conjunction with a conventional pilot drill bit positioned below or downstream of the underreamer. The pilot bit can drill the borehole at the same time as the underreamer enlarges the borehole formed by the bit. Underreamers of this type usually have hinged arms with roller cone cutters attached thereto. Most of the prior art underreamers utilize swing out cutter arms that are pivoted at an end opposite the cutting end of the cutting arms, and the cutter arms are actuated by mechanical or hydraulic forces acting on the arms to extend or retract them. Typical examples of these types of underreamers are found in U.S. Pat. Nos. 3,224,507; 3,425,500 and 4,055,226. In some designs, these pivoted arms tend to break during the drilling operation and must be removed or "fished" out of the borehole before the drilling operation can continue. The traditional underreamer tool typically has rotary cutter pocket recesses formed in the body for storing the retracted arms and roller cone cutters when the tool is in a closed state. The pocket recesses form large cavities in the underreamer body, which requires the removal of the structural metal forming the body, thereby compromising the strength and the hydraulic capacity of the underreamer. Accordingly, these prior art underreamers may not be capable of underreaming harder rock formations, or may have unacceptably slow rates of penetration, and they are not optimized for the high fluid flow rates required. The pocket recesses also tend to fill with debris from the drilling operation, which hinders collapsing of the arms. If the arms do not fully collapse, the drill string may easily hang up in the borehole when an attempt is made to remove the string from the borehole.

Conventional underreamers have several disadvantages, including cutting structures that are typically formed of sections of drill bits rather than being specifically designed for the underreaming function. Therefore, the cutting structures of most underreamers do not reliably underream the borehole to the desired diameter. A further disadvantage is that adjusting the expanded diameter of a conventional underreamer requires replacement of the cutting arms with larger or smaller arms, or replacement of other components of the underreamer tool. It may even be necessary to replace the underreamer altogether with one that provides a different expanded diameter. Another disadvantage is that many underreamers are designed to automatically expand when drilling fluid is pumped through the drill string, and no indication is provided at the surface that the underreamer is in the fully-expanded position. In some applications, it may be desirable for the operator to control when the underreamer expands.

Accordingly, it would be advantageous to provide an underreamer that is stronger than prior art underreamers, with a hydraulic capacity that is optimized for the high flowrate drilling environment. It would further be advantageous for such an underreamer to include several design features, namely cutting structures designed for the underreaming function, mechanisms for adjustment of the expanded diameter without requiring component changes, and the ability to provide indication at the surface when the underreamer is in the fully-expanded position. Moreover, in the presence of hydraulic pressure in the drill string, it would be advantageous to provide an underreamer that is selectively expandable.

Another method for enlarging a borehole below a previously cased borehole section includes using a winged reamer behind a conventional drill bit. In such an assembly, a conventional pilot drill bit is disposed at the lowermost end of the drilling assembly with a winged reamer disposed at some distance behind the drill bit. The winged reamer generally comprises a tubular body with one or more longitudinally extending "wings" or blades projecting radially outwardly from the tubular body. Once the winged reamer has passed through any cased portions of the wellbore, the pilot bit rotates about the centerline of the drilling axis to drill a lower borehole on center in the desired trajectory of the well path, while the eccentric winged reamer follows the pilot bit and engages the formation to enlarge the pilot borehole to the desired diameter.

Yet another method for enlarging a borehole below a previously cased borehole section includes using a bi-center bit, which is a one-piece drilling structure that provides a combination underreamer and pilot bit. The pilot bit is disposed on the lowermost end of the drilling assembly, and the eccentric underreamer bit is disposed slightly above the pilot bit. Once the bi-center bit has passed through any cased portions of the wellbore, the pilot bit rotates about the centerline of the drilling axis and drills a pilot borehole on center in the desired trajectory of the well path, while the eccentric underreamer bit follows the pilot bit and engages the formation to enlarge the pilot borehole to the desired diameter. The diameter of the pilot bit is made as large as possible for stability while still being capable of passing through the cased borehole. Examples of bi-center bits may be found in U.S. Pat. Nos. 6,039,131 and 6,269,893.

As described above, winged reamers and bi-center bits each include underreamer portions that are eccentric. A number of disadvantages are associated with this design. First, before drilling can continue, cement and float equipment at the bottom of the lowermost casing string must be drilled out. However, the pass-through diameter of the drilling assembly at the eccentric underreamer portion barely fits within the lowermost casing string. Therefore, off-center drilling is required to drill out the cement and float equipment to ensure that the eccentric underreamer portions do not damage the casing. Accordingly, it is desirable to provide an underreamer that collapses while the drilling assembly is in the casing and that expands to underream the previously drilled borehole to the desired diameter below the casing.

Further, due to directional tendency problems, these eccentric underreamer portions have difficulty reliably underreaming the borehole to the desired diameter. With respect to a bi-center bit, the eccentric underreamer bit tends to cause the pilot bit to wobble and undesirably deviate off center, thereby pushing the pilot bit away from the preferred trajectory of drilling the well path. A similar problem is experienced with respect to winged reamers, which only underream the borehole to the desired diameter if the pilot bit remains centralized in the borehole during drilling. Accordingly, it is desirable to provide an underreamer that remains concentrically disposed in the borehole while underreaming the previously drilled borehole to the desired diameter.

In drilling operations, it is conventional to employ a tool known as a "stabilizer." In standard boreholes, traditional stabilizers are located in the drilling assembly behind the drill bit for controlling the trajectory of the drill bit as drilling progresses. Traditional stabilizers control drilling in a desired direction, whether the direction is along a straight borehole or a deviated borehole.

In a conventional rotary drilling assembly, a drill bit may be mounted onto a lower stabilizer, which is disposed approximately 5 feet above the bit. Typically the lower stabilizer is a fixed blade stabilizer that includes a plurality of concentric blades extending radially outwardly and spaced azimuthally around the circumference of the stabilizer housing. The outer edges of the blades are adapted to contact the wall of the existing cased borehole, thereby defining the maximum stabilizer diameter that will pass through the casing. A plurality of drill collars extends between the lower stabilizer and other stabilizers in the drilling assembly. An upper stabilizer is typically positioned in the drill string approximately 30–60 feet above the lower stabilizer. There could also be additional stabilizers above the upper stabilizer. The upper stabilizer may be either a fixed blade stabilizer or, more recently, an adjustable blade stabilizer that allows the blades to be collapsed into the housing as the drilling assembly passes through the casing and then expanded in the borehole below. One type of adjustable concentric stabilizer is manufactured by Andergauge U.S.A., Inc., Spring, Tex. and is described in U.S. Pat. No. 4,848,490. Another type of adjustable concentric stabilizer is manufactured by Halliburton, Houston, Tex. and is described in U.S. Pat. Nos. 5,318,137; 5,318,138; and 5,332,048.

In operation, if only the lower stabilizer was provided, a "fulcrum" type assembly would be present because the lower stabilizer acts as a fulcrum or pivot point for the bit. Namely, as drilling progresses in a deviated borehole, for example, the weight of the drill collars behind the lower stabilizer forces the stabilizer to push against the lower side of the borehole, thereby creating a fulcrum or pivot point for the drill bit. Accordingly, the drill bit tends to be lifted upwardly at an angle, i.e. build angle. Therefore, a second stabilizer is provided to offset the fulcrum effect. Namely, as the drill bit builds angle due to the fulcrum effect created by the lower stabilizer, the upper stabilizer engages the lower side of the borehole, thereby causing the longitudinal axis of the bit to pivot downwardly so as to drop angle. A radial change of the blades of the upper stabilizer can control the pivoting of the bit on the lower stabilizer, thereby providing a two-dimensional, gravity based steerable system to control the build or drop angle of the drilled borehole as desired.

When an underreamer or a winged reamer tool is operating behind a conventional bit to underream the borehole, that tool provides the same fulcrum effect to the bit as the lower stabilizer in a standard borehole. Similarly, when underreaming a borehole with a bi-center bit, the eccentric underreamer bit provides the same fulcrum effect as the lower stabilizer in a standard borehole. Accordingly, in a drilling assembly employing an underreamer, winged reamer, or a bi-center bit, a lower stabilizer is not typically provided. However, to offset the fulcrum effect imparted by to the drill bit, it would be advantageous to provide an upper stabilizer capable of controlling the inclination of the drilling assembly in the underreamed section of borehole.

In particular, it would be advantageous to provide an upper stabilizer that engages the wall of the underreamed borehole to keep the centerline of the pilot bit centered within the borehole. When utilized with an eccentric underreamer that tends to force the pilot bit off center, the stabilizer blades would preferably engage the opposite side of the expanded borehole to counter that force and keep the pilot bit on center.

BRIEF SUMMARY OF THE INVENTION

In various embodiments, a downhole expandable tool may be used as an underreamer to enlarge the diameter of a borehole below a restriction, or may be used as a stabilizer to control the directional tendencies of a drilling assembly in an underreamed borehole.

Disclosed herein is a method of underreaming a wellbore to form an enlarged borehole and controlling the directional tendencies of a drilling assembly comprising using a drill bit to drill the wellbore, disposing a first expandable tool having at least one arm configured for stabilizing directly above the drill bit, using the first expandable tool to control the directional tendencies of the drilling assembly, disposing a second expandable tool having at least one arm configured for underreaming above the first expandable tool, and using the second expandable tool to form the enlarged borehole, wherein both the first expandable tool and the second expandable tool operate between a collapsed position and an expanded position. In an embodiment, the method further comprises operating the first expandable tool in the collapsed position to control the directional tendencies of the drilling assembly, and/or operating the second expandable tool in the expanded position to form the enlarged borehole. The method may further comprise providing an indication at the surface corresponding to the position of either the first expandable tool or the second expandable tool. In an embodiment, the first expandable tool and the second expandable tool have the same design. In an embodiment, either or both of the first expandable tool and the second expandable tool must be selectively aligned to enable translation between the collapsed position and the expanded position in response to a differential pressure. Alternatively, one of the first expandable tool and the second expandable tool may automatically translate between the collapsed position and the expanded position in response to a differential pressure. In an embodiment, the method further comprises directing a fluid across a borehole engaging surface when the second expandable tool is operating in the expanded position.

Also disclosed herein is an arm for an expandable downhole tool comprising a top surface, a bottom surface, two side surfaces each having a length and each having a plurality of angular extensions disposed substantially along the length, and a front surface comprising at least one borehole engaging pad. In an embodiment, the top and bottom surfaces are angled and engage the tool. The extensions may slideably interfit between a plurality of channels in the tool to provide support to the arm during loading. In an embodiment, the at least one borehole engaging pad comprises cutting structures or wear structures or a combination thereof. The at least one borehole engaging pad may comprise two upper pads, a middle pad, and two lower pads. In various embodiments, the at least one engaging pad provides back reaming capability when the pad engages a borehole, stabilizes the tool when the pad engages a borehole, provides gauge protection when the pad engages a borehole, provides underreaming capability when the pad engages a borehole, or a combination thereof Further disclosed herein is an arm of an expandable downhole tool comprising a substantially arcuate borehole engaging surface having at least two tapered pads wherein the surface comprises cutting structures, wear structures, or a combination thereof. In an embodiment, the arm further comprises at least one substantially flat pad. The arm may further be hydraulically activated to retract substantially into a body of said expandable downhole tool and to extend outwardly from said body.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION

Figure 2:
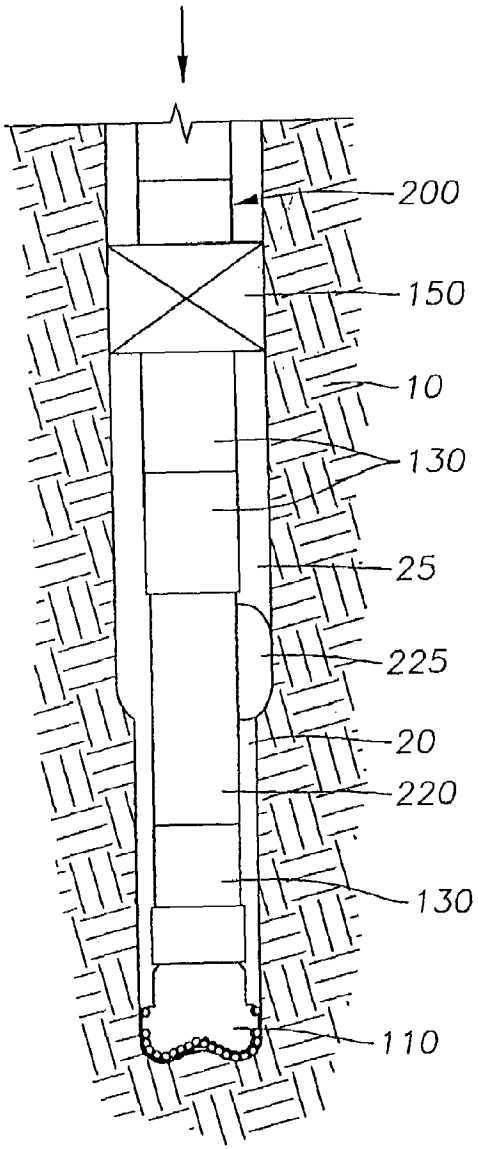
FIG. 2 is a schematic, cross-sectional view of another exemplary drilling assembly that employs one embodiment of the invention and that includes a conventional drill bit drilling a borehole within a formation, a winged reamer enlarging the borehole above the bit, and a stabilizer above the winged reamer controlling the directional tendencies of the drilling assembly in the underreamed borehole.

The present invention relates to methods and apparatus for underreaming to enlarge a borehole below a restriction, such as casing. Alternatively, the present invention relates to methods and apparatus for stabilizing a drilling assembly and thereby controlling the directional tendencies of the drilling assembly within an enlarged borehole. The present invention is susceptible to embodiments of different forms. There are shown in the drawings, and herein will be described in detail, specific embodiments of the present invention with the understanding that the disclosure is to be considered an exemplification of the principles of the invention, and is not intended to limit the invention to that illustrated and described herein.

In particular, various embodiments of the present invention provide a number of different constructions and methods of operation. Each of the various embodiments of the present invention may be used to enlarge a borehole, or to provide stabilization in a previously enlarged borehole, or in a borehole that is simultaneously being enlarged. The preferred embodiments of the expandable tool of the present invention may be utilized as an underreamer, or as a stabilizer behind a bi-center bit, or as a stabilizer behind a winged reamer or underreamer following a conventional bit. The embodiments of the present invention also provide a plurality of methods for use in a drilling assembly. It is to be fully recognized that the different teachings of the embodiments disclosed herein may be employed separately or in any suitable combination to produce desired results.

It should be appreciated that the expandable tool described with respect to the Figures that follow may be used in many different drilling assemblies. The following exemplary systems provide only some of the representative assemblies within which the present invention may be used, but these should not be considered the only assemblies. In particular, the preferred embodiments of the expandable tool of the present invention may be used in any assembly requiring an expandable underreamer and/or stabilizer for use in controlling the directional tendencies of a drilling assembly in an expanded borehole.

Figure 1:
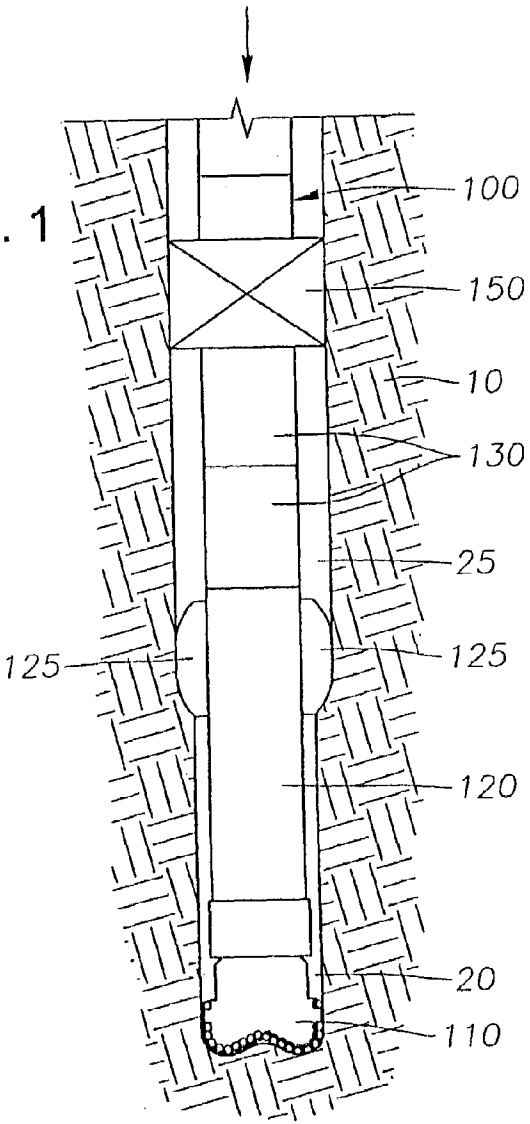
FIG. 1 is a schematic, cross-sectional view of an exemplary drilling assembly that employs one embodiment of the invention and that includes a conventional drill bit drilling a borehole within a formation, an underreamer enlarging the borehole above the bit, and a stabilizer above the underreamer controlling the directional tendencies of the drilling assembly in the underreamed borehole.
Figure 3:
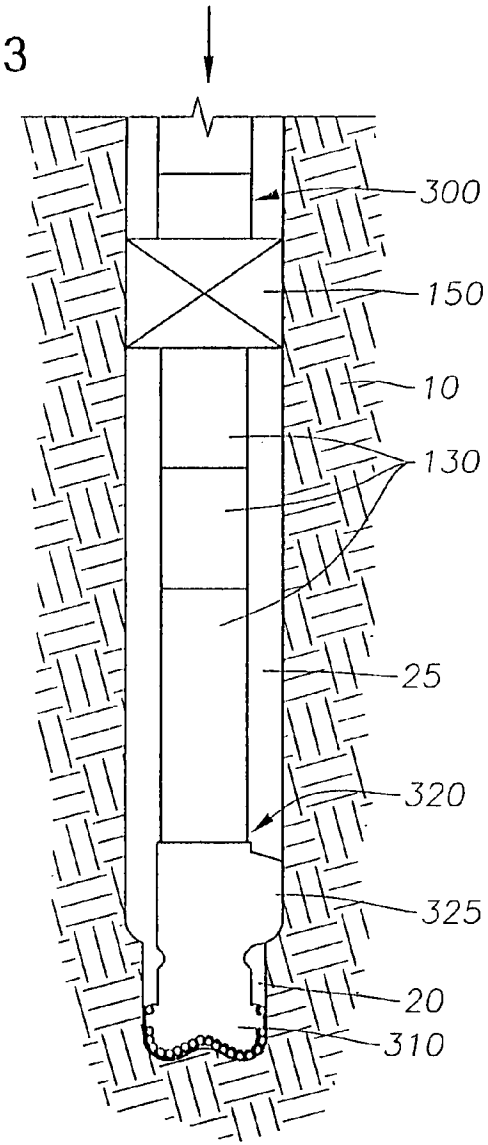
FIG. 3 is a schematic, cross-sectional view of still another exemplary drilling assembly that employs one embodiment of the invention and that includes a bi-center bit drilling and enlarging a borehole within a formation, and a stabilizer above the bi-center bit controlling the directional tendencies of the drilling assembly in the underreamed borehole.

FIGS. 1–3 show various exemplary drilling assemblies within which the preferred embodiments of the present invention may be utilized. Referring initially to FIG. 1, a section of a drilling assembly generally designated as 100 is shown drilling into the bottom of a formation 10 with a conventional drill bit 110 followed by an underreamer 120. Separated from the underreamer 120 by one or more drill collars 130 is a stabilizer 150 that controls the directional tendencies of the drilling assembly 100 in the underreamed borehole 25. This section of the drilling assembly 100 is shown at the bottom of formation 10 drilling a borehole 20 with the conventional drill bit 110, while the underreamer cutting arms 125 are simultaneously opening a larger diameter borehole 25 above. The drilling assembly 100 is operating below any cased portions of the well.

As described previously, the underreamer 120 tends to provide a fulcrum or pivot effect to the drill bit 110, thereby requiring a stabilizer 150 to offset this effect. In the preferred embodiment of the drilling assembly 100, various embodiments of the expandable tool of the present invention are provided in the positions of both the underreamer 120 and the stabilizer 150. In the most preferred embodiment, the stabilizer 150 would also preferably include cutting structures to ensure that the larger borehole 25 is enlarged to the proper diameter. However, any conventional underreamer may alternatively be utilized with one embodiment of the present invention provided in the position of stabilizer 150 in the drilling assembly 100. Further, one embodiment of the present invention may be utilized in the position of underreamer 120, and a conventional stabilizer may be utilized in the position of stabilizer 150.

Referring now to FIG. 2, where like numerals represent like components, a drilling assembly 200 is shown disposed within formation 10, below any cased sections of the well. The drilling assembly 200 is drilling a borehole 20 utilizing a conventional drill bit 110 followed by a winged reamer 220. The winged reamer 220 may be separated from the drill bit 110 by one or more drill collars 130, but preferably the winged reamer 220 is connected directly above the drill bit 110. Upstream of the winged reamer 220, separated by one or more drill collars 130, is a stabilizer 150 that controls the directional tendencies of the drilling assembly 200 in the underreamed borehole 25. The drill bit 110 is shown at the bottom of the formation 10 drilling a borehole 20, while the wing component 225 of the winged reamer 220 is simultaneously opening a larger diameter borehole 25 above. In the preferred assembly 200, a preferred embodiment of the present invention would be located in the position of stabilizer 150. In a most preferred assembly 200, the stabilizer 150 would also include cutting structures to ensure that the larger borehole 25 is enlarged to the proper diameter.

Referring to FIG. 3, where like numerals represent like components, again a drilling assembly 300 is shown disposed within formation 10, below any cased sections of the well. The drilling assembly 300 utilizes a bi-center bit 320 that includes a pilot bit 310 and an eccentric underreamer bit 325. As the pilot bit 310 drills the borehole 20, the eccentric underreamer bit 325 opens a larger diameter borehole 25 above. The bi-center bit 320 is separated by one or more drill collars 130 from a stabilizer 150 designed to control the directional tendencies of the bi-center bit 320 in the underreamed borehole 25. Again, the function of the stabilizer 150 is to offset the fulcrum or pivot effect created by the eccentric underreamer bit 325 to ensure that the pilot bit 310 stays centered as it drills the borehole 20. In the preferred embodiment of the drilling assembly 300, one embodiment of the expandable tool of the present invention would be located in the position of stabilizer 150. In a most preferred assembly 300, the stabilizer 150 would also include cutting structures to ensure that the larger borehole 25 is enlarged to the proper diameter.

Figure 4:
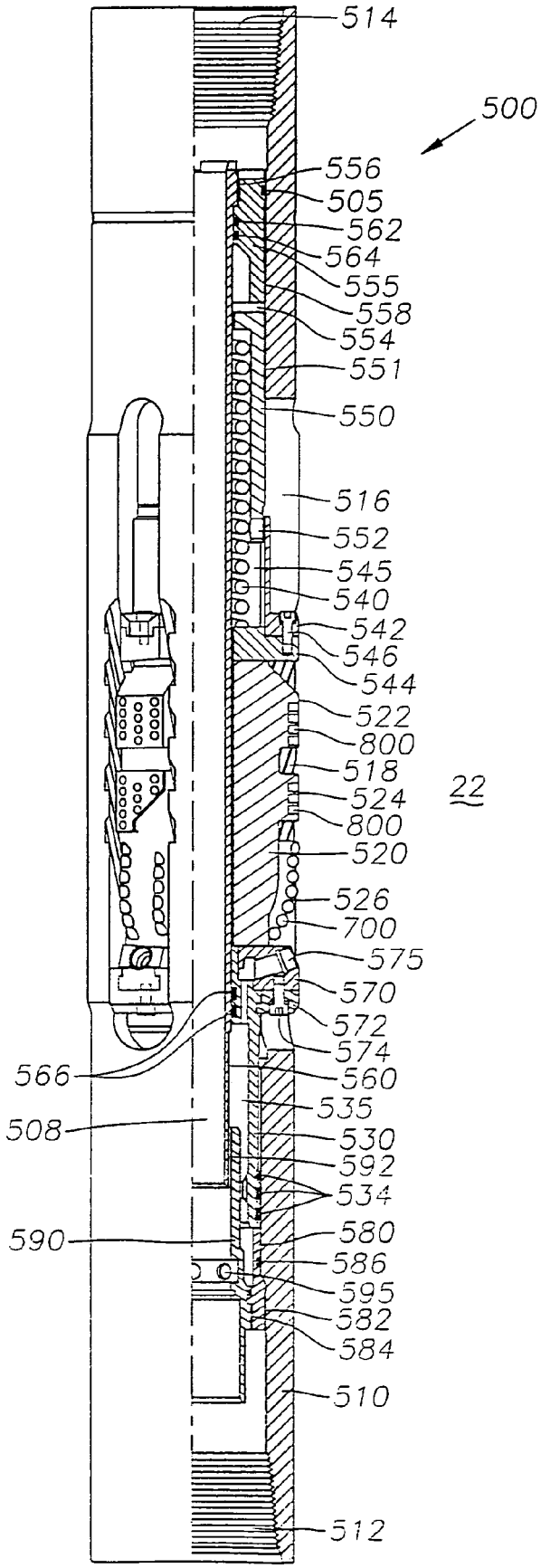
FIG. 4 is a cross-sectional elevation view of one embodiment of the expandable tool of the present invention, showing the moveable arms in the collapsed position.
Figure 5:
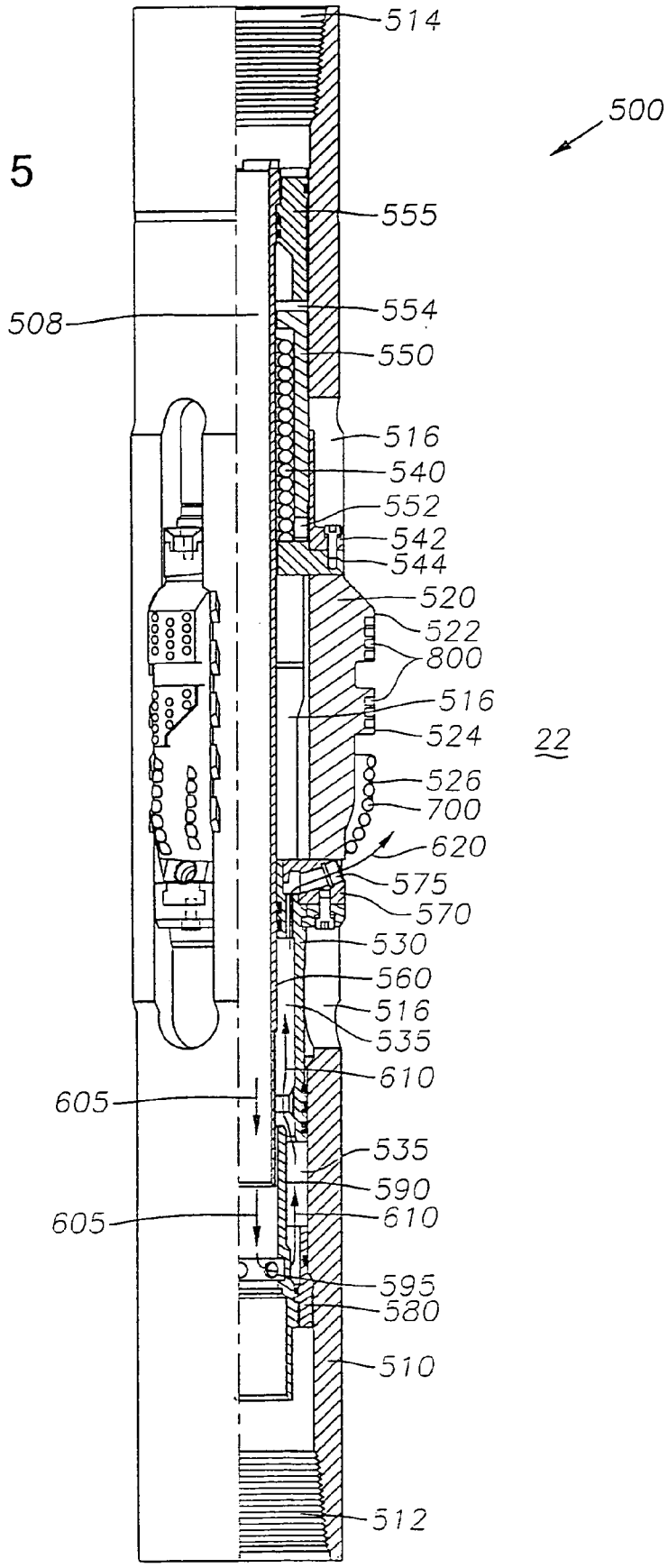
FIG. 5 is a cross-sectional elevation view of the expandable tool of FIG. 4, showing the moveable arms in the expanded position.

Referring now to FIGS. 4 and 5, one embodiment of the expandable tool of the present invention, generally designated as 500, is shown in a collapsed position in FIG. 4 and in an expanded position in FIG. 5. The expandable tool 500 comprises a generally cylindrical tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position. The preferred embodiment of the expandable tool includes three moveable arms 520 disposed within three pocket recesses 516. In the discussion that follows, the one or more recesses 516 and the one or more arms 520 may be referred to in the plural form, i.e. recesses 516 and arms 520. Nevertheless, it should be appreciated that the scope of the present invention also comprises one recess 516 and one arm 520.

The recesses 516 further include angled channels 518 that provide a drive mechanism for the moveable tool arms 520 to move axially upwardly and radially outwardly into the expanded position of FIG. 5. A biasing spring 540 is preferably including to bias the arms 520 to the collapsed position of FIG. 4. The biasing spring 540 is disposed within a spring cavity 545 and covered by a spring retainer 550. Retainer 550 is locked in position by an upper cap 555. A stop ring 544 is provided at the lower end of spring 540 to keep the spring 540 in position.

Below the moveable arms 520, a drive ring 570 is provided that includes one or more nozzles 575. An actuating piston 530 that forms a piston cavity 535, engages the drive ring 570. A drive ring block 572 connects the piston 530 to the drive ring 570 via bolt 574. The piston 530 is adapted to move axially in the pocket recesses 516. A lower cap 580 provides a lower stop for the axial movement of the piston 530. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564. A wrench slot 554 is provided between the upper cap 555 and the spring retainer 550, which provides room for a wrench to be inserted to adjust the position of the spring retainer 550 in the body 510. Spring retainer 550 connects at 551 via threads to the body 510. Towards the lower end of the spring retainer 550, a bore 552 is provided through which a bar can be placed to prevent rotation of the spring retainer 550 during assembly. For safety purposes, a spring cover 542 is bolted at 546 to the stop ring 544. The spring cover 542 prevents personnel from incurring injury during assembly and testing of the tool 500.

The moveable arms 520 include pads 522, 524, and 526 with structures 700, 800 that engage the borehole when the arms 520 are expanded outwardly to the expanded position of the tool 500 shown in FIG. 5. Below the arms 520, the piston 530 sealingly engages the inner mandrel 560 at 566, and sealingly engages the body 510 at 534. The lower cap 580 is threadingly connected to the body and to the lower retainer 590 at 582, 584, respectively. A sealing engagement is also provided at 586 between the lower cap 580 and the body 510. The lower cap 580 provides a stop for the piston 530 to control the collapsed diameter of the tool 500.

Several components are provided for assembly rather than for functional purposes. For example, the drive ring 570 is coupled to the piston 530, and then the drive ring block 572 is boltingly connected at 574 to prevent the drive ring 570 and the piston 530 from translating axially relative to one another. The drive ring block 572, therefore, provides a locking connection between the drive ring 570 and the piston 530.

FIG. 5 depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 4 or an expanded position as shown in FIG. 5. However, the spring retainer 550, which is a threaded sleeve, can be adjusted at the surface to limit the full diameter expansion of arms 520. The spring retainer 550 compresses the biasing spring 540 when the tool 500 is collapsed, and the position of the spring retainer 550 determines the amount of expansion of the arms 520. The spring retainer 550 is adjusted by a wrench in the wrench slot 554 that rotates the spring retainer 550 axially downwardly or upwardly with respect to the body 510 at threads 551. The upper cap 555 is also a threaded component that locks the spring retainer 550 once it has been positioned. Accordingly, one advantage of the present tool is the ability to adjust at the surface the expanded diameter of the tool 500. Unlike conventional underreamer tools, this adjustment can be made without replacing any components of the tool 500.

In the expanded position shown in FIG. 5, the arms 520 will either underream the borehole or stabilize the drilling assembly, depending upon how the pads 522, 524 and 526 are configured. In the configuration of FIGS. 5, cutting structures 700 on pads 526 would underream the borehole. Wear buttons 800 on pads 522 and 524 would provide gauge protection as the underreaming progresses. Hydraulic force causes the arms 520 to expand outwardly to the position shown in FIG. 5 due to the differential pressure of the drilling fluid between the flowbore 508 and the annulus 22.

The drilling fluid flows along path 605, through ports 595 in the lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 4 to the position shown in FIG. 5. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

The underreamer tool 500 of the one embodiment of the present invention solves the problems experienced with bi-center bits and winged reamers because it is designed to remain concentrically disposed within the borehole. In particular, the tool 500 of the present invention preferably includes three extendable arms 520 spaced apart circumferentially at the same axial location on the tool 510. In the preferred embodiment, the circumferential spacing would be 120° apart. This three arm design provides a full gauge underreaming tool 500 that remains centralized in the borehole at all times.

Another feature of the preferred embodiments of the present invention is the ability of the tool 500 to provide hydraulic indication at the surface, thereby informing the operator whether the tool is in the contracted position shown in FIG. 4, or the expanded position shown in FIG. 5. Namely, in the contracted position, the flow area within piston chamber 535 is smaller than the flow area within piston chamber 535 when the tool 500 is in the expanded position shown in FIG. 5. Therefore, in the expanded position, the flow area in chamber 535 is larger, providing a greater flow area between the flowbore 508 and the wellbore annulus 22. In response, pressure at the surface will decrease as compared to the pressure at the surface when the tool 500 is contracted. This decrease in pressure indicates that the tool 500 is expanded.

Figure 6:
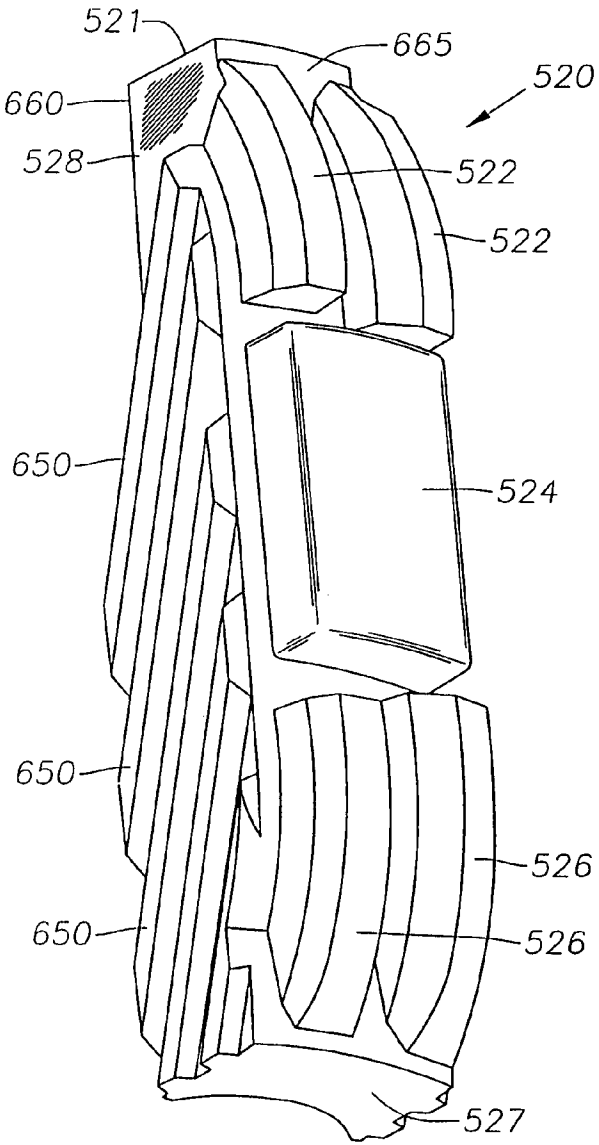
FIG. 6 is a perspective view of a "blank" arm for the expandable tool of FIG. 4.

FIGS. 6–10 provide more detail regarding the moveable arms 520 and drive ring 570 of FIGS. 4 and 5. FIG. 6 shows a "blank" arm 520 with no cutting structures or stabilizing structures attached to pads 522, 524, 526. The arm 520 is shown in isometric view to depict a top surface 521, a bottom surface 527, a front surface 665, a back surface 660, and a side surface 528. The top surface 521 and the bottom surface 527 are preferably angled, as described in more detail below. The arm 520 preferably includes two upper pads 522, one middle pad 524, and two lower pads 526 disposed on the front surface 665 of the arm 520. The arm 520 also includes extensions 650 disposed along each side 528 of arm 520. The extensions 650 preferably extend upwardly at an angle from the bottom 527 of the arm 520 towards pads 522, 524 and 526. The extensions 650 protrude outwardly from the arm 520 to fit within corresponding channels 518 in the pocket recess 516 of the tool body 510, as shown in FIGS. 4 and 5. The interconnection between the arm extensions 650 and the body channels 518 increases the surface area of contact between the moveable arms 520 and the tool body 5 10, thereby providing a more robust expandable tool 500 as compared to prior art tools. The arm 520 depicted in FIG. 6 is a blank version of either an underreamer cutting arm or a stabilizer arm. By changing the structures disposed on pads 522, 524 and 526, the tool 500 is converted from an underreamer to a stabilizer or vice versa, or to a combination underreamer/stabilizer.

Figure 7:
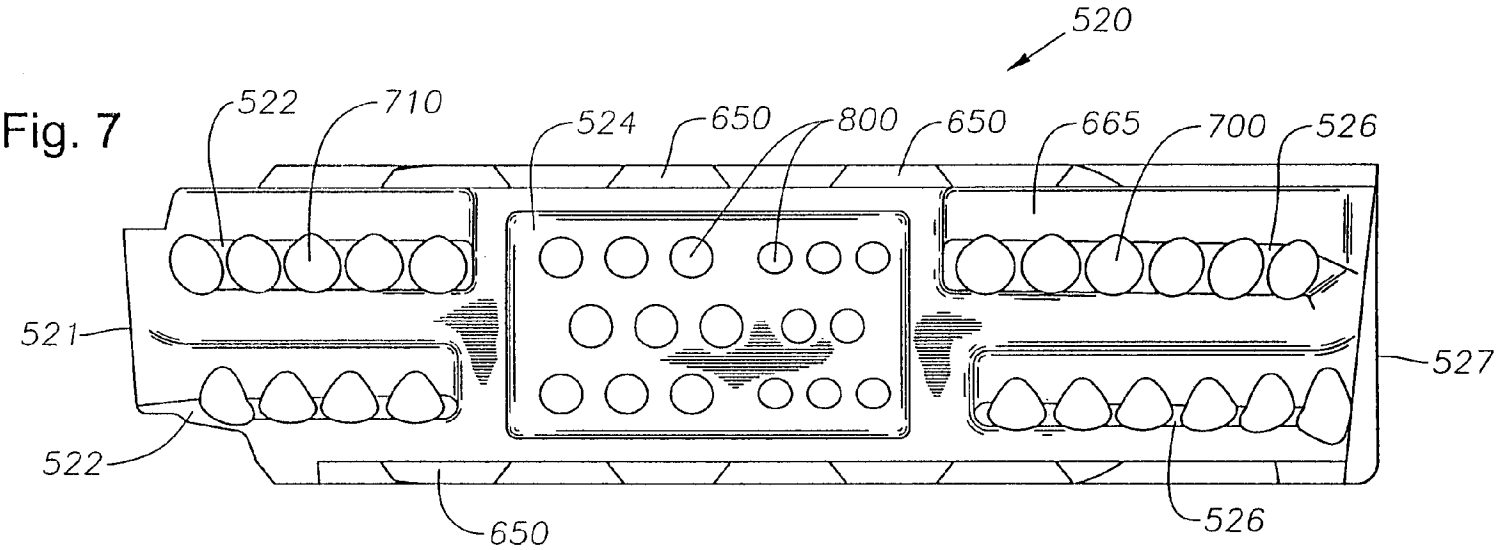
FIG. 7 is a top view of an exemplary arm for the expandable tool of FIG. 4 including a wear pad and cutting structures for back reaming and underreaming.
Figure 8:
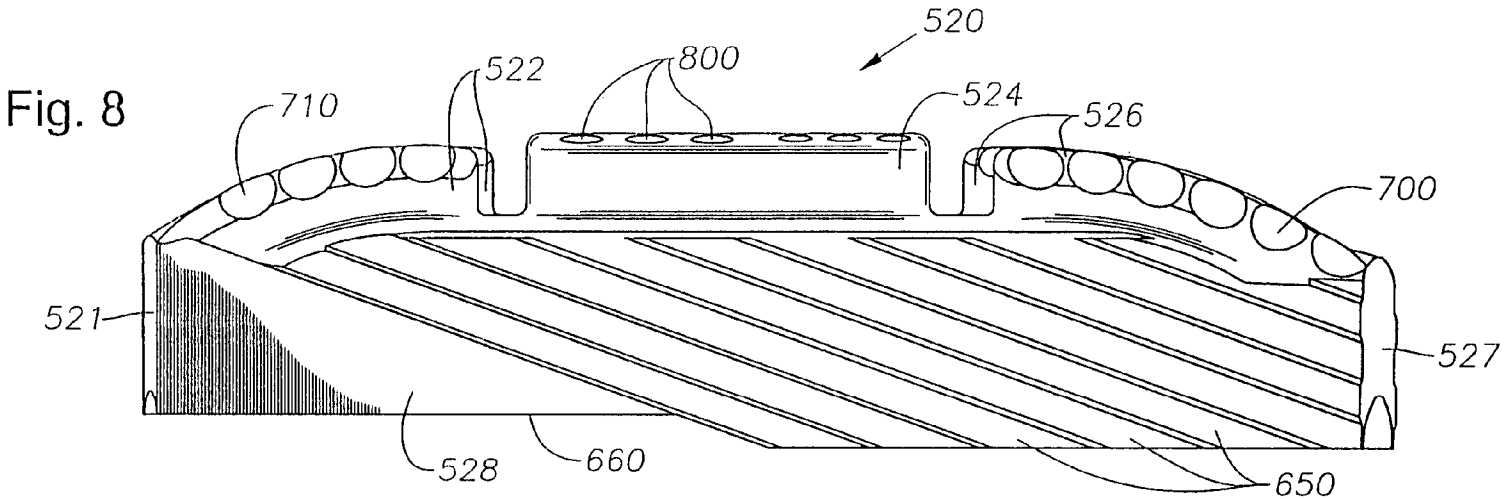
FIG. 8 is a side elevation view of the arm of FIG. 7.
Figure 9:
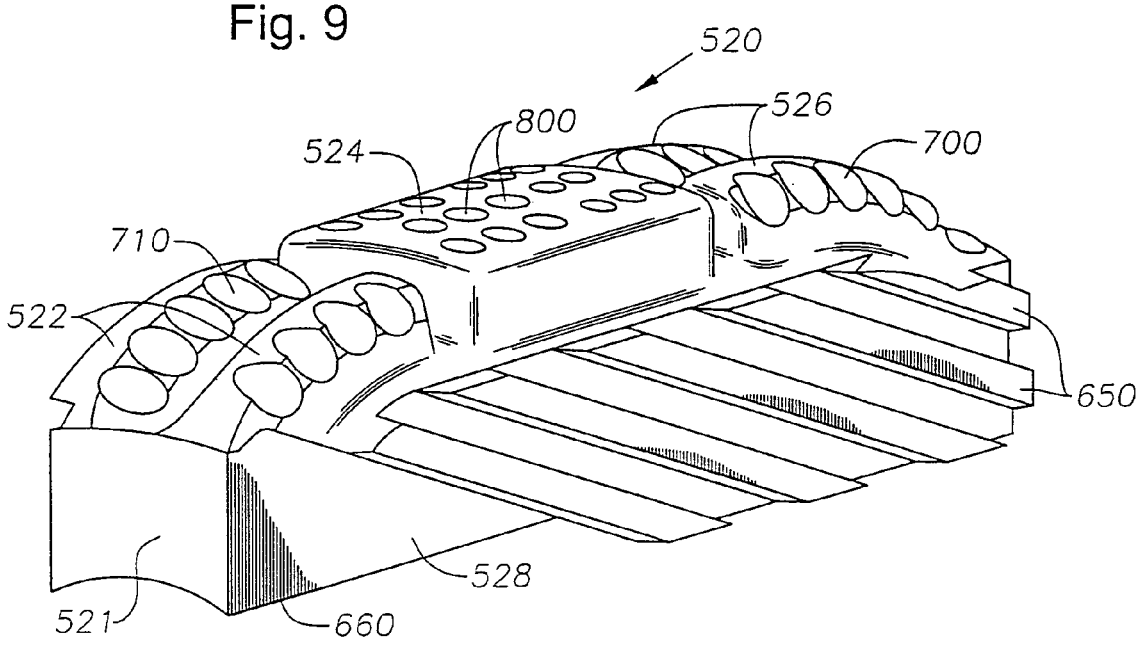
FIG. 9 is a perspective view of the arm of FIG. 7.

Referring now to FIGS. 7, 8 and 9, an exemplary arm 520 is shown that includes two sets of cutting structures 700, 710. FIG. 7 depicts the arm 520 from a top perspective, FIG. 8 provides an elevational side view, and FIG. 9 shows an isometric perspective. The top surface 521 and the bottom surface 527 of the arm 520 are preferably angled in the same direction as best shown in FIG. 7. These surfaces 521, 527 are designed to prevent the arm 520 from vibrating when pads 522, 524 and 526 engage the borehole. Namely, when pads 522, 524 and 526 engage the borehole, the arms 520 are held in compression by the piston 530. The angled top surface 521 and the angled bottom surface 527 bias the arms 520 to the trailing side of the pocket recesses 516 to minimize vibration.

In the top view of FIG. 7, pads 522 comprise cutting structures 710 such that the arm 520 provides back reaming capabilities. Back reaming is pulling the tool 500 upwardly in the borehole while underreaming. Pad 524 is preferably covered with wear buttons 800 that provide a stabilizing and gauge protection function. Pads 526 comprise cutting structures 700 for underreaming. In the side view of FIG. 8, the extensions 650 that fit within channels 518 of the body 510 are shown extending upwardly at an angle along the side 528 from the back surface 660 of the arm 520 towards pads 522, 524 and 526. FIG. 9 shows the same arm 520 in isometric view.

To change the arm 520 shown in FIGS. 7, 8, and 9 from a back reaming and underreaming arm to simply an underreaming arm, the back reaming cutting structures 710 would be replaced with wear buttons, such as buttons 800. This configuration would result in the underreaming arm 520 shown in FIGS. 4 and 5. Modifying the tool 500 from an underreamer to a stabilizer simply requires providing stabilizing structures on all of the pads 522, 524 and 526. As a stabilizer, surfaces 522, 524, and 526 would be covered with a dense plurality of wear buttons 800 without any cutting structures. The preferred material for the wear buttons 800 is a tungsten carbide or diamond material, which provides good wear capabilities. In an alternative embodiment, the pads 522, 524, and 526 may be coated with a hardened material called TCI 300H hardfacing.

Accordingly, the pads 522, 524, 526 could comprise a variety of structures and configurations utilizing a variety of different materials. When the tool is used in an underreaming function, a variety of different cutting structures 700 could be provided on surfaces 526, depending upon the formation characteristics. Preferably, the cutting structures 700, 710 for underreaming and back reaming, respectively, are specially designed for the particular cutting function. More preferably, the cutting structures 700, 710 comprise the cutting structures disclosed and claimed in co-pending U.S. Patent application Ser. No. 09/924,961, filed Aug. 8, 2001, entitled "*Advanced Expandable Reaming Tool*," assigned to Smith International, Inc., which is hereby incorporated herein by reference.

Figure 10:
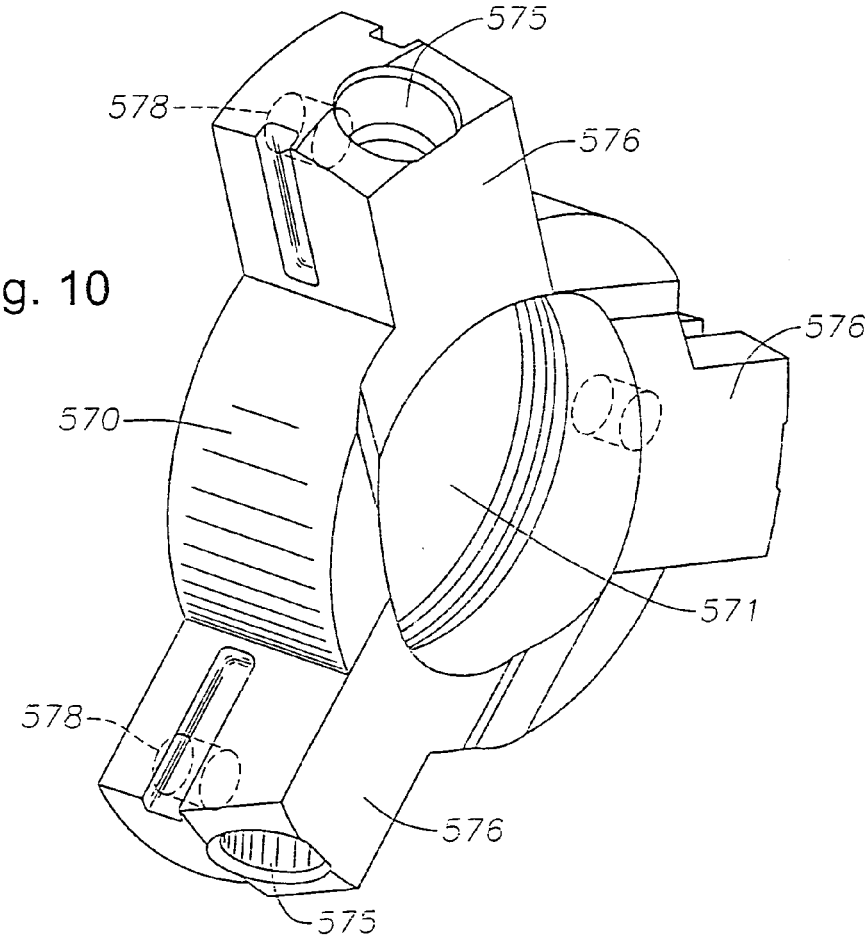
FIG. 10 is a perspective view of the drive ring of the expandable tool of FIG. 4.

Referring now to FIG. 10, additional advantages of the preferred embodiments of the present invention are provided by the one or more nozzles 575 disposed in the drive ring 570. The underreamer/stabilizer of the preferred embodiments of the present invention preferably includes three moveable arms 520 spaced apart circumferentially at the same axial location along the tool body 510. In the preferred embodiment, the three moveable arms 520 are spaced 120° circumferentially. This arrangement of the arms 520 is preferred to centralize the tool 500 in the borehole. The drive ring 570 is moveable with the arms 520 and preferably includes three extended portions 576 spaced 120° circumferentially with angled nozzles 575 therethrough that are designed to direct drilling fluid to the cutting structures 700 of the underreamer at surfaces 526. The boreholes 578 in the extended portions 576 adjacent nozzles 575 accept bolts 574 to connect the drive ring 570 to the drive ring block 572 and piston 530. An aperture 571 is disposed through the center of the drive ring 570 to enable a connection to the piston 530. Because the drive ring 570 is connected to the piston 530, it moves with the piston 530 to push the moveable arms 520 axially upwardly and outwardly along the channels 518 to the expanded position. Accordingly, because drive ring 570 moves with the arms 520, the nozzles 575 continuously provide drilling fluid to the cutting structures 700 on the underreamer surfaces 526. The nozzles 575 are optimally placed to move with and follow the cutting structures 700 and thereby assure that the cutters 700 are properly cleaned and cooled at all times.

Figure 11:
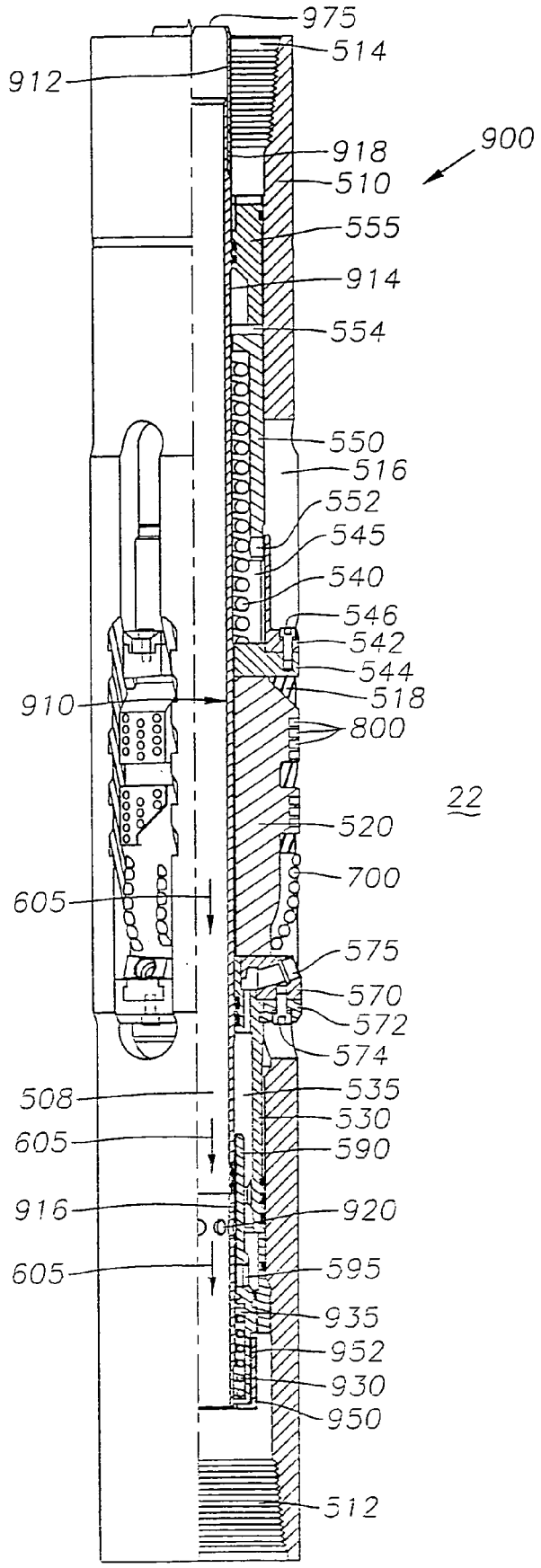
FIG. 11 is a cross-sectional elevation view of an alternative embodiment of the expandable tool of the present invention, showing the moveable arms in the collapsed position.
Figure 12:
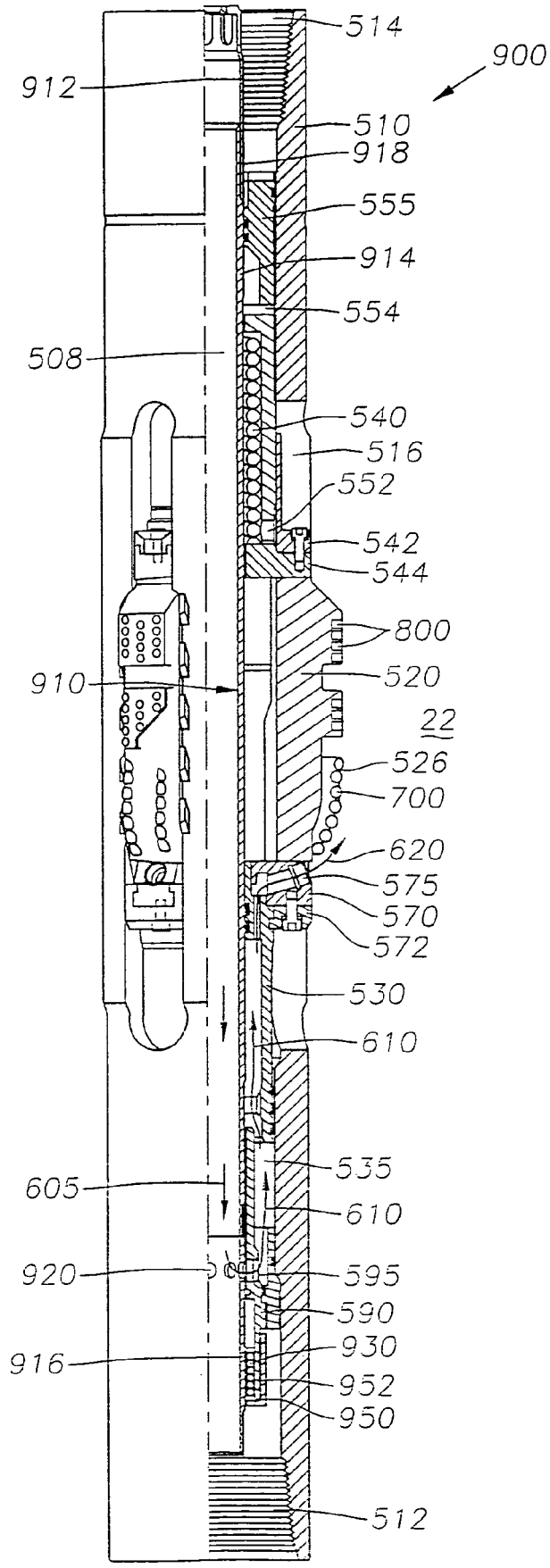
FIG. 12 is a cross-sectional elevation view of the alternative embodiment of FIG. 11, showing the moveable arms in the expanded position.

FIGS. 11 and 12 depict a second embodiment of the present invention, generally designated as 900, in the collapsed and expanded positions, respectively. Many components of tool 900 are the same as the components of embodiment 500, and those components maintain the same reference numerals. There are, however, several differences. The inner mandrel 560 of the first embodiment tool 500 is replaced by a stinger assembly 910, preferably comprising an upper inner mandrel 912, a middle inner mandrel 914, and a lower inner mandrel 916. The lower inner mandrel 916 includes ports 920 that must align with ports 595 in the lower retainer 590 before fluid can enter piston chamber 535 to actuate the piston 530. As shown in FIG. 11, fluid flows through the flowbore 508 of tool 900, along pathway 605 depicted by the arrows. Because the ports 920 of the lower inner mandrel 916 do not align with the ports 595 of the lower retainer 590, the fluid continues flowing along path 605, past ports 595, down through the tool 900.

The tool 900 is selectively actuated utilizing an actuator (not shown), which aligns the ports 920 with the ports 595 to enable the expandable tool to move from the contracted position shown in FIG. 11 to the expanded position shown in FIG. 12. Below lower inner mandrel 916, a bottom spring 930 is disposed within a bottom spring chamber 935 and held within the body 510 by a bottom spring retainer 950. Bottom spring retainer 950 threadingly connects at 952 to the lower retainer 590. The spring 930 biases the stinger assembly 910 upwardly such that stinger 910 must be forced downwardly by an actuator to overcome the force of bottom spring 930. By moving the stinger 910 downwardly, the ports 920 disposed circumferentially around the bottom of lower inner mandrel 916 align with the ports 595 of lower retainer 590 that lead into piston chamber 535.

FIG. 12 shows the tool 900 in an expanded position. In this position, drilling fluid flows through the flowbore 508, along pathway 605. However, because stinger 910 has been actuated downwardly against the force of bottom spring 930 by an actuator, the ports 920 in lower inner mandrel 916 now align with ports 595 in the lower retainer 590. Therefore, when the drilling fluid proceeds downwardly along flow path 605 through the flowbore 508 to reach ports 920, it will flow through ports 920, 595 and into the piston chamber 535 as depicted by flow arrows 610.

Due to the differential pressure between the flowbore 508 and the wellbore annulus 22 surrounding tool 900, the fluid flowing along pathway 610 will actuate the piston 530 upwardly against the force of spring 540. The piston 530 will push the drive ring 570, which will push the arms 520 axially upwardly and outwardly as the extensions 650 on the arms 520 move along channels 518 in the body 510. Once the fluid flows through the nozzles 575 in the drive ring 570, it exits at an angle along pathway 620 to cool and clean the cutting structures 700 disposed on surfaces 526 that underream the borehole. Accordingly, the second embodiment 900 of FIGS. 11 and 12 is capable of being selectively actuated. Namely, by engaging the upper surface 975 of stinger 910 with an actuator, the tool 900 can be selectively actuated at the election of the operator to align the ports 920 and 595. The preferred actuator is the flow switch described and claimed in U.S. Pat. No. 6,289,999 entitled "*Fluid Flow Control Devices and Methods for Selective Actuation of Valves and Hydraulic Drilling Tools*," hereby incorporated herein by reference.

Referring again to FIGS. 11 and 12, typically a gap is provided between the upper end 975 of the stinger 910 and the actuator when the tool is in the collapsed position. That gap length must be maintained to ensure that actuation occurs only when it is meant to occur. Accordingly, upper inner mandrel 912 may include an adjustment ring portion 918, which is just a spacer ring that makes up any discrepancies in the area between the upper inner mandrel 912 and the middle inner mandrel 914 such that the appropriate gap dimension can be maintained.

As one of ordinary skill in the art will readily appreciate, any actuating mechanism can be utilized to selectively actuate the tool 900 of FIGS. 11 and 12. However, the preferred flow switch provides the advantage of additional hydraulic indications to the surface, in addition to the pressure indications provided by the increased flow area in the piston chamber 535 when the tool 900 is in the expanded position of FIG. 12. Namely, the preferred flow switch includes an uplink pulser capable of providing position and status information to the surface via mud pulse telemetry. Accordingly, the preferred embodiment comprises the tool 900 of FIGS. 11 and 12, and more preferably comprises the tool 900 in combination with the referenced flow switch.

In operation, an expandable tool 500 or 900 is lowered through casing in the collapsed position shown in FIGS. 4 and 11, respectively. The first embodiment of the tool 500 would then be expanded automatically when drilling fluid flows through flowbore 508, and the second embodiment of the tool 900 would be expanded only after selectively actuating the tool 900. Whether the selective actuation feature is present or not, the tools 500, 900 expand due to differential pressure between the flow bore 508 and the wellbore annulus 22 acting on the piston 530. That differential pressure may be in the range of 800 to 1,500 psi. Therefore, differential pressure working across the piston 530 will cause the one or more arms 520 of the tool to move from a collapsed to an expanded position against the force of the biasing spring 540.

Before the drilling assembly is lowered into the borehole, the function of the present invention as either an underreamer or as a stabilizer would be determined. Referring again to FIG. 1, one example would be to use either embodiment of the tool 500, 900 in the position of underreamer 120, and preferably to use the second embodiment of the tool 900 in the position of stabilizer 150. As another example, referring to FIGS. 2 and 3, if a winged reamer 220 or a bi-center bit 320 is used instead of an underreamer 120, the second embodiment of the tool 900 would preferably be used in the position of stabilizer 150. As an underreamer, the preferred embodiments of the present invention are capable of underreaming a borehole to a desired diameter. As a stabilizer, the preferred embodiments of the present invention provide directional control for the assembly 100, 200, 300 within the underreamed borehole 25.

In summary, the various embodiments of the expandable tool of the present invention may be used as an underreamer to enlarge a borehole below a restriction to a larger diameter. Alternatively, the various embodiments of the expandable tool may be used to stabilize a drilling system in a previously underreamed borehole, or in a borehole that is being underreamed while drilling progresses. The various embodiments of the present invention solve the problems of the prior art and include other features and advantages. Namely, the embodiments of the present expandable tool are stronger and have a higher hydraulic capacity than prior art underreamers. The preferred embodiments of the tool also provide pressure indications at the surface regarding whether the tool is collapsed or expanded. The tool preferably includes a novel assembly for moving the arms to the expanded position. Yet another advantage of the preferred embodiments is that the tool can be used in conjunction with other conventional devices such as a winged reamer or a bi-center bit to ensure that they function properly. The preferred embodiments of the tool further include one or more optimally placed and moveable nozzles for cleaning and cooling the cutting structures. Finally, the preferred embodiments of the present invention allow for adjustable expanded diameters without component changes.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A method of underreaming a wellbore to form an enlarged borehole and controlling the directional tendencies of a drilling assembly, comprising:

using a drill bit to drill the wellbore;

disposing a first expandable tool configured for stabilizing and underreaming directly above the drill bit;

using the first expandable tool to control the directional tendencies of the drilling assembly;

disposing a second expandable tool configured for underreaming above the first expandable tool; and using the second expandable tool to form the enlarged borehole;

wherein both the first expandable tool and the second expandable tool operate between a collapsed position and an expanded position.

2. The method of claim 1 further comprising operating the first expandable tool in the collapsed position to control the directional tendencies of the drilling assembly.

3. The method of claim 1 further comprising operating the second expandable tool in the expanded position to form the enlarged borehole.

4. The method of claim 3 further comprising directing a fluid across a borehole engaging surface when the second expandable tool is operating in the expanded position.

5. The method of claim 1 further comprising providing an indication at the surface corresponding to the position of either the first expandable tool or the second expandable tool.

6. The method of claim 1 wherein the first expandable tool and the second expandable tool have the same design.

7. The method of claim 1 wherein the first expandable tool must be selectively aligned and the second expandable tool must be selectively aligned to enable translation between the collapsed position and the expanded position in response to a differential pressure.

8. The method of claim 1 wherein the first expandable tool must be selectively aligned to enable translation between the collapsed position and the expanded position and the second expandable tool automatically translates between the collapsed position and the expanded position in response to a differential pressure.

9. An arm of an expandable downhole tool comprising:

a top surface;

a bottom surface;

two side surfaces each having a length and each having a plurality of angular extensions disposed substantially along said length; and a front surface comprising at least one borehole engaging pad;

wherein said at least one borehole engaging pad provides underreaming capability when said pad engages a borehole.

10. The arm of claim 9 wherein said top and bottom surfaces are angled and engage said tool.

11. The arm of claim 9 wherein said extensions slideably interfit between a plurality of channels in said tool to provide support to said arm during loading.

12. The arm of claim 9 wherein said at least one borehole engaging pad comprises cutting structures or wear structures or a combination thereof.

13. The arm of claim 9 wherein said at least one borehole engaging pad comprises two upper pads, a middle pad, and two lower pads.

14. The arm of claim 9 wherein said at least one borehole engaging pad is adapted to provide back reaming capability when said pad engages a borehole.

15. The arm of claim 9 wherein said at least one borehole engaging pad stabilizes said tool when said pad engages a borehole.

16. The arm of claim 9 wherein said at least one borehole engaging pad provides gauge protection when said pad engages a borehole.

* * * * *